US006695234B2

(12) United States Patent
Wilbraham

(10) Patent No.: US 6,695,234 B2
(45) Date of Patent: Feb. 24, 2004

(54) LIQUID FUEL INJECTION NOZZLES

(75) Inventor: Nigel Wilbraham, Leicester (GB)

(73) Assignee: Alstone Power N.V., Amsterdam (NL)

( * ) Notice: Subject to any disclaimer, the term of this patent is extended or adjusted under 35 U.S.C. 154(b) by 11 days.

(21) Appl. No.: 09/823,930

(22) Filed: Mar. 30, 2001

(65) Prior Publication Data

US 2001/0045474 A1 Nov. 29, 2001

(30) Foreign Application Priority Data

Apr. 1, 2000 (GB) ..... 0007970
Apr. 1, 2000 (GB) ..... 0007971

(51) Int. Cl.[7] ..... B05B 5/00; B05B 7/10; F23D 11/32; F02C 1/00; F02G 3/00

(52) U.S. Cl. ..... 239/706; 239/690; 239/707; 239/403; 60/740; 60/776

(58) Field of Search ..... 239/690, 696, 239/705, 706, 707, 708, 403, 404, 405, 406; 60/39.06, 740, 748, 776

(56) References Cited

U.S. PATENT DOCUMENTS

| | | | | |
|---|---|---|---|---|
| 3,167,109 A | | 1/1965 | Wobig | |
| 3,746,253 A | * | 7/1973 | Walberg | 239/705 |
| 3,749,545 A | | 7/1973 | Velkoff | |
| 4,439,980 A | | 4/1984 | Biblarz et al. | |
| 4,508,265 A | * | 4/1985 | Jido | 239/3 |
| 4,938,019 A | * | 7/1990 | Angell et al. | 60/778 |
| 5,297,738 A | | 3/1994 | Lehr et al. | |
| 5,515,681 A | * | 5/1996 | DeFreitas | 60/740 |
| 5,588,299 A | | 12/1996 | DeFreitas | |
| 5,590,517 A | * | 1/1997 | DeFreitas | 60/776 |
| 5,628,180 A | * | 5/1997 | DeFreitas | 60/776 |
| 5,695,328 A | * | 12/1997 | DeFreitas et al. | 431/268 |
| 6,206,307 B1 | * | 3/2001 | Kelly et al. | 239/690 |
| 6,289,676 B1 | * | 9/2001 | Prociw et al. | 60/740 |
| 6,474,573 B1 | * | 11/2002 | Kelly | 239/690 |

FOREIGN PATENT DOCUMENTS

| | | |
|---|---|---|
| DE | 1 401 799 | 10/1968 |
| EP | 0 626 537 A2 | 5/1994 |
| EP | 0 728 989 A2 | 8/1996 |
| JP | 61008508 | 1/1986 |

* cited by examiner

*Primary Examiner*—Michael Mar
*Assistant Examiner*—Darren Gorman
(74) *Attorney, Agent, or Firm*—Kirschstein, et al.

(57) ABSTRACT

A liquid fuel injection nozzle to supply atomized droplets of fuel to a combustion chamber arrangement in a gas turbine engine combustion system. The fuel droplets leave the passage through its upper end defined by an annular sharp edge of a tubular electrode which can be electrostatically charged for the sharp edge to impart electrostatic charge to the fuel droplets as they pass the edge.

11 Claims, 2 Drawing Sheets

LIQUID FUEL INJECTION NOZZLES

FIELD OF THE INVENTION

This invention concerns liquid fuel injection nozzles for supplying atomized droplets of fuel to a combustion chamber arrangement in a gas turbine engine combustion system. It also concerns such combustion systems and gas turbine engines provided with such combustion systems.

BACKGROUND OF THE INVENTION

It is known to improve atomization and placement or positioning of liquid fuels within gas turbine engine combustion chambers by the use of electrodes located so as to impart electrostatic charge to the fuel droplets. For example, U.S. Pat. No. 4,439,980 discloses a gas turbine engine wherein fuel is injected through a spray injection nozzle towards an electrode in a combustion chamber so that after it has left the injection nozzle, the fuel becomes electrostatically charged, and the strength of the electric field is adjusted to provide a spray characteristic said to produce an optimum engine performance.

The inventor believes that further increased control of fuel placement, vaporization and combustion intensity is desirable. This would lead to greater combustion stability, particularly at low fuel injection rates, and lower emission of pollutants from engines.

SUMMARY OF THE INVENTION

An object of the present invention is therefore to provide a liquid fuel injection nozzle suitable for a gas turbine engine combustion system, by means of which one or more of fuel atomization, vaporization, placement and combustion intensity may be more accurately controlled to produce an improved combustion performance.

According to the invention there is provided a liquid fuel injection nozzle for supplying atomized droplets of fuel to a combustion chamber in a gas turbine engine, the nozzle comprising a passage with an exit for the droplets to leave the nozzle, and electrode means disposed around the passage, the electrode means having sharp edge means positioned to impart electrostatic charge to the droplets as they leave the nozzle.

Preferably at least the sharp edge comprises an erosion resistant material and may comprise the exit of the nozzle. Alternatively, the electrode means may be adjacent the exit of the nozzle.

If desired, the relatively sharp edge may project substantially along a general direction of flow of fuel along the passage, or alternatively the sharp edge may project substantially across said general direction of flow of fuel.

The electrode arrangement may form at least part of a wall of the nozzle passage.

A gas turbine engine combustion system may comprise at least one liquid fuel injection nozzle formed according to the invention, and further electrode means connected to charging means arranged to electrostatically charge the further electrode means at predetermined polarities with respect to the nozzle electrode means.

In an embodiment a gas turbine engine combustion system comprises:

a combustion main chamber, a combustion pre-chamber upstream thereof and opening into the main chamber, the pre-chamber being of smaller flow area than the main chamber and being disposed about a longitudinal axis, a burner face at an upstream end of the pre-chamber, a preswirler assembly comprising a plurality of preswirl passages communicating with the upstream end of the pre-chamber for supplying a preswirled air/fuel mixture to the pre-chamber, the preswirl passages being disposed about the longitudinal axis, a plurality of liquid fuel atomizing injection nozzles formed according to the invention and located in the preswirl passages to inject atomized liquid fuel thereinto, charging means operable to selectively electrostatically charge the nozzle electrode means at a pre-determined polarity thereby to impart electrostatic charge to the atomized fuel, preswirl electrode means forming at least portions of the preswirl passages, and charging means operable to selectively electrostatically charge the preswirl electrode means at the same polarity as the nozzle electrode means, thereby to repel the atomized injected fuel from the preswirl passage portions.

There may be provided a first burner electrode means associated with the burner face, and means for holding the first burner electrode means at a potential with respect to the electrostatically charged fuel such that the fuel is biased towards the first burner electrode means.

A second burner electrode means may be associated with the burner face, means being provided to selectively electrostatically charge the second burner electrode means at the same polarity as the charged fuel. The second burner electrode means preferably surrounds the first burner electrode means.

A fuel ignition means is conveniently embedded in the burner face and located between a radially inner outlet from a said swirler passage and the first burner electrode means.

The pre-chamber may be provided with pre-chamber electrode means comprising at least a portion of the pre-chamber, charging means being provided to selectively electrostatically charge the pre-chamber electrode means at the same polarity as the charge on the fuel.

Further aspects of the invention will be apparent from the following description and claims.

BRIEF DESCRIPTION OF THE DRAWINGS

Embodiments of the invention will now be described by way of example only, with reference to the accompanying drawings, in which.

DESCRIPTION OF THE PREFERRED EMBODIMENTS

Figure 1:
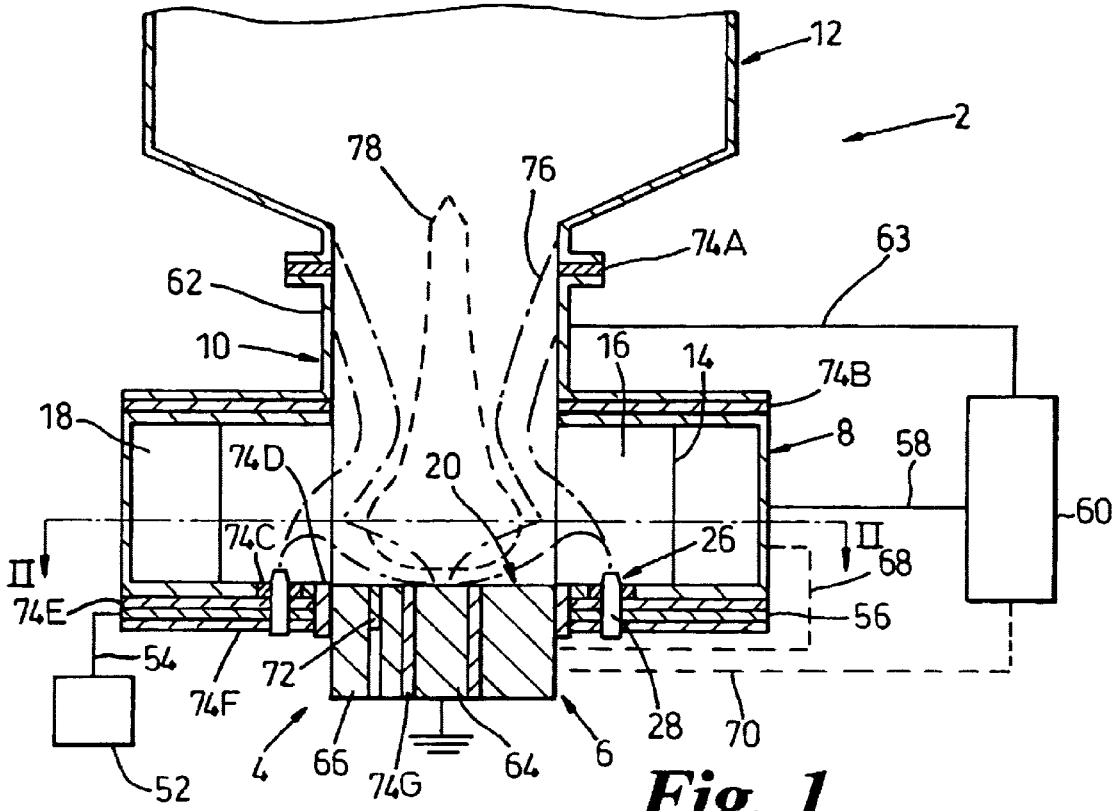
FIG. 1 is a diagrammatic and fragmentary longitudinal section of an embodiment of a gas turbine engine combustion system comprising liquid fuel injection nozzles formed according to the invention.

In the drawings like references identify like or comparable parts.

Figure 2:
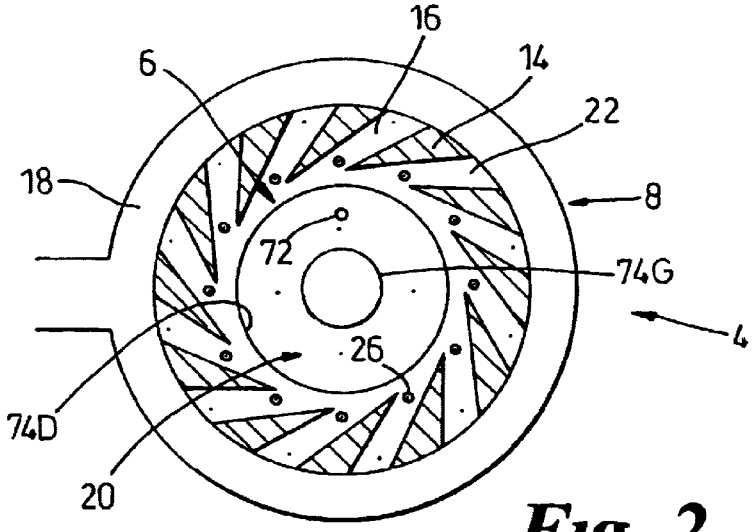
FIG. 2 is a representation of a section on line II—II in FIG. 1 including certain further information.

With reference to FIGS. 1 and 2 a gas turbine engine (not shown) comprises a plurality of combustors, such a combustor being indicated at 2. The combustor 2 comprises a burner 4 having a burner head 6, an inflowing swirler assembly 8, a cylindrical pre-chamber 10, and a larger diameter main combustion chamber 12 downstream of the pre-chamber.

The swirler assembly 8 comprises a plurality of swirler vanes 14 disposed about a central axis and separating passages 16 along which compressed combustion air flows generally inwardly from an encircling manifold 18 supplied with compressed air by the compressor of the gas turbine engine. As shown particularly in FIG. 2, passages 16 are oriented substantially tangentially to the periphery of the pre-chamber 10. On leaving the passages 16 the combustion air enters the pre-chamber 10 adjacent to its upstream end with large tangential and smaller radial components of velocity. A burner face 20 of the burner head 6 is disposed at the upstream end of the pre-chamber 10.

The combustor 2 can burn fuel gas, for example, natural gas, or atomized liquid fuel. When operating with fuel gas, pilot fuel gas can be supplied to the pre-chamber 10 by a pilot gas system (not shown) whereas the main fuel gas supply is through gas jets or nozzles 22 (indicated only in FIG. 2) opening into the swirler passages 16 adjacent to the radially outer ends of the passages. When operating in liquid fuel mode, pilot liquid fuel is supplied from liquid fuel pilot jets or nozzles 26 at the burner face 20, and main liquid fuel is supplied in atomized droplets form from main liquid fuel injection jets or nozzles 26 opening into the swirler passages 16 adjacent to the radially inner or outlet ends of the swirler passages.

Each injection nozzle 26 is connected to a suitable supply of liquid fuel via a liquid fuel manifold (not shown) associated with the combustion system.

Figure 3:
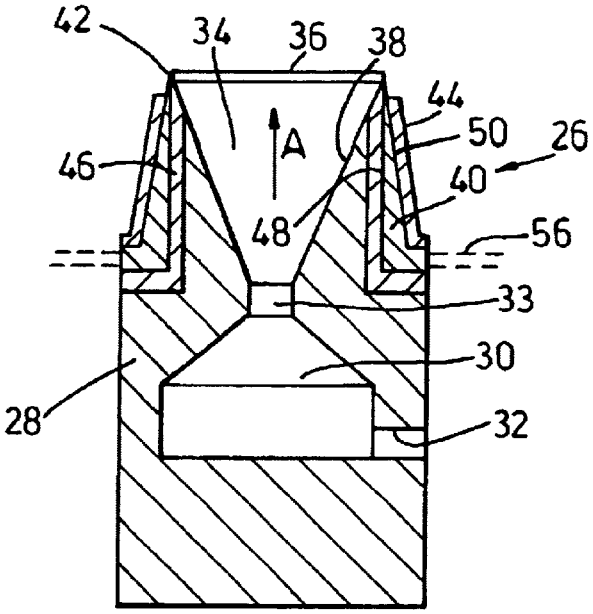
FIG. 3 is a diagrammatic longitudinal sections of an embodiment of an fuel injection nozzle formed according to the invention which can be used in the combustion system in FIG. 1.
Figure 4:
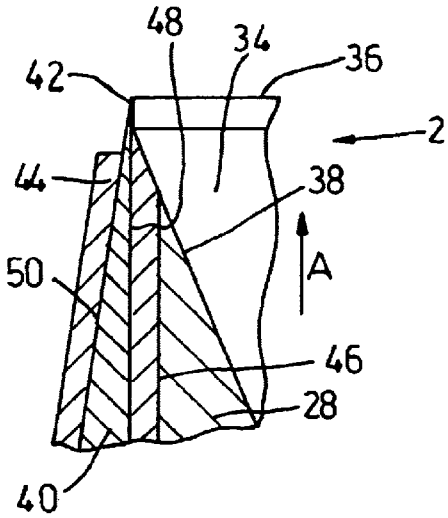
FIG. 4 is a fragment of the section in FIG. 3 shown enlarged with respect to FIG. 3.

With reference to FIGS. 3 and 4, each injection nozzle 26 comprises a nozzle body 28 provided with a circular section spin chamber 30 (known per se). Liquid fuel enters the spin chamber tangentially through an equi-angularly spaced array of bores or slots 32 and is thrown out though throat 33 and divergent passage 34 in a general direction A to an outlet 36. The passage 34 widens progressively along direction A so that a wall portion 38 of the passage 34 is of substantially frusto-conical shape. Due to the vigorous rotational motion given to the fuel in the spin chamber, it tends to flow along the interior surface of the wall 38 and upon reaching the outlet 36 of the nozzle, it is atomized into small droplets as it expands out of the passage 34 into the airstream within the preswirler passages. This type of fuel nozzle is manufactured by Delavan Gas Turbine Products Division of BF Goodrich Aerospace, 811 4$^{th}$ Street, West Des Moines, Iowa 50265, U.S.A.

The present embodiment of the invention adds to this known type of fuel injection nozzle a tubular electrode 40 of electrically conducting material which surrounds the nozzle body 28 and defines the outlet 36 of the passage 34. At the outlet 36, the electrode 40 has a substantially circular continuous sharp edge 42, which projects substantially along the direction of passage of the fuel through the nozzle. Apart from its uppermost end, the electrode 40 is sandwiched between tubular layers 44 and 46 of electrical insulation which insulate it from the environment and from the nozzle body 28 and which may be made of, for example, mica or a ceramic material. A radially inner surface 48 of electrode 40 is substantially cylindrical to match the shape of the outer surface of the nozzle body 28, while its radially outer surface 50 is substantially frusto-conical so as to define the included angle of the sharp edge 42.

In defining the edge 42 of the electrode 40 as sharp, the inventor means sufficiently sharp to effectively impart charge to the fuel droplets as they rapidly leave the outlet 46 of the nozzle. For example, the inventor estimates that to fulfil this function, the edge 42 may have an included angle of about one half of a degree, and a radius of not more than about one micron, though the inventor does not wish to be held to these values. It will be evident to the skilled person that to resist erosion from the fuel passing thereover and to maintain its sharpness over a long period, the electrode, or at least its exposed tip with sharp edge 42, should be made of a suitably hard, conductive and heat-resistant material, such as high speed tool steel or a hard facing material such as Stellite 6 (Trade Mark).

Advantageously, the electrostatic charge is imparted to the fuel by the electrode just at the point when the stream of fuel which adheres to the interior wall of the nozzle passage 34 starts to break up into droplets as it leaves the nozzle outlet end 36. To provide this charge, a charge supply and control unit 52, as known per se, (see FIG. 1) is connected by line 54 to an annular conductor 56 supplying the electrodes 40 of the nozzles 26. Preferably, the electrodes, and hence the fuel droplets exiting the nozzles 26, are positively charged.

Returning to FIGS. 1 and 2, the swirler assembly 8, or at least wall portions of the swirler passages 16, for example surfaces of the vanes 14, comprise an electrode charged electrostatically via line 58 by another charge supply and control unit 60. When charged, the electrode 8 is charged at the same polarity as the fuel droplets.

Pre-chamber 10 has a chamber wall 62 which also comprises an electrode charged electrostatically via line 63 by the supply and control unit 60. When charged, electrode 62 is charged at the same polarity as the fuel droplets.

The burner head 6 comprises two electrodes 64 and 66 exhibiting electrode faces at the burner face 20. Electrode 64 is a central electrode represented as a cylinder in the drawings and electrode 66 is a surrounding electrode represented as a ring. The electrode 66 is charged electrostatically at the same polarity as the fuel droplets. This may be achieved by connecting the electrode 66 conductively to the electrode 8 by a conductive connection 68 so that the electrodes 8 and 66 are at the same potential. Alternatively, there may be no connection 68 and instead a line 70 may be provided so that electrode 66 may be charged by the supply and control 36 via the line 70, in which case the electrode 66 may be at a different potential to that of the electrode 8.

Preferably central electrode 64 is to be charged oppositely to the fuel, or at least to a lower potential. This may be achieved by connecting the electrode 64 to a suitable electrostatic charge supply and control unit, or may be achieved, when the fuel charge is positive, by grounding central electrode 64 so as to be at a lower potential than the electrodes of the nozzles 26 and the other electrodes 8, 62 and 66.

An igniter for the fuel is represented at 72 embedded in the face of the electrode 66 and may be adjacent to a periphery of the central electrode 64.

Insulation, for example mica or a ceramic, to maintain electrodes isolated from one another or other parts of the system is indicated at 74A, 74B, 74C, 74D, 74E, 74F and 74G.

The fuel emitted by nozzle 26 may be selectively electrostatically charged or not charged by the units 52, 60, as desired, depending on the desired nature of operation of the gas turbine engine. In particular, during operation of the engine at low loads, when lower volumes of liquid fuel are being delivered to the injector nozzles 26, the additional control of fuel atomization, vaporization, placement and combustion intensity obtainable by electrostatic charging of the electrodes is advantageous. Also as desired the electrodes 8, 62, 64 and 66 may be charged simultaneously or only one or any combination thereof charged or held at any appropriate desired potential. Under full load operation of the engine, when larger volumes of liquid fuel are being delivered to the injector nozzles 26, good fuel atomization, vaporization, placement and combustion intensity may be achievable if none of the electrodes are charged.

The control units 52 and 60 may operate independently and control unit 60 may charge the respective electrodes, to which it is connected, to different respective extents or potentials. The source of static electricity may be a battery, or be derived from an auxiliary electrical generator driven by the gas turbine engine.

With particular reference to FIG. 1, when the engine is performing under ignition operation mode with the liquid fuel from nozzles 26 positively charged and central electrode 64 grounded, (i) electrodes 8 and 66 may be positively charged and may be at the same potential, for example via connection 68, and (ii) electrode 62 may also be positively charged, for example slightly charged and thus be at a lesser potential with respect to the electrodes 8, 66. An example of an electrostatic field within the combustion system is indicated by dot-dash lines 76 and a resulting fuel placement position or envelope demarcating the position of the fuel flow is indicated by interrupted lines 78. The charged droplets tend to be repelled from the swirler assembly 8 and from the wall 62 so the chance of that wall or those in assembly 8 becoming coked due to burning of fuel on their surfaces is reduced. Also, since the fuel is biased towards the central electrode 64, either by being attracted towards it, or at least by being less repelled by it than by the other electrodes, the chance of it being more effectively ignited by the igniter 72 as fuel moves thereover is improved. Fuel is not only electrostatically repelled by the swirler vanes 14 but also by the electrode 66. By reason of the electrostatic conditions described at ignition operation, liquid fuel vaporization rate is increased by (1) better fuel atomization (Coulomb Fission), by (2) Coulomb force which is much greater than usual aerodynamic force so the fuel droplets can move against air flows, and by (3) Coulomb force preventing droplets coalescing.

When the engine is performing under load shed operation, the positive charge imparted to the fuel may preferably be a maximum that the system can provide. Central burner electrode 64 is grounded and (i) electrodes 8 and 66 may be positively charged, and may be at the same potential, and (ii) electrode 62 may also be positively charged, but to a higher potential than for ignition operation. Consequently, the electrostatic field is pinched within pre-chamber 10, so again biasing the fuel/air mixture towards the electrode 64. Electrodes 8, 62 and 66 may be at the same or different potentials. The effect of the electrostatic field on the fuel is to improve or increase its atomization, which is desirable when fuel flow rate is reduced. Also, high charge on electrodes 66 and 62 in combination with the grounded electrode 64 pulls and pushes the fuel upstream towards the center of the burner head 6 at the upstream end of the pre-chamber 10 resulting in improved fuel concentration and therefore improved flame stability.

The inventor's copending U.S. patent application of even date herewith, the entire contents of which are hereby incorporated herein by reference thereto, and claiming priority from patent application No. GB0007970.7 gives further disclosure of such gas turbine engine combustion systems and the reader is referred thereto for further details not included in the present specification.

The use of electrostatic control of fuel placement can assist in:(a)

(a) Controlling NOx emissions.

(b) Improving flame stability at ignition and load shed operation modes.

(c) Reducing the need to use more than one set of fuel nozzles to inject liquid fuel.

(d) Reducing rumble in combustion systems, due to the reduction or elimination of unsteady combustion.

(e) Enhancing fuel vaporization rates and thereby reducing NOx.

(f) Enabling liquid fuel staging to be used in "can" type combustion systems. Liquid fuel staging is the technique of using the same injector nozzle or set of nozzles to inject fuel at low flow rates for low load operation and also at higher flow rates for operation of the engine at higher loads. Hitherto, this has been very difficult to achieve because conventional injector nozzles must be designed to exhibit optimum atomization over a restricted range of flow rates. The present invention tackles this problem by enabling better control of atomization and placement of the fuel within the combustor.

(g) Enabling use of a use of higher flow number liquid fuel injector nozzles while reducing the risk of coking of surfaces in the preswirler and the pre-chamber. Here, "flow number" is the UK flow number and is defined as the fuel flow rate through the nozzle in imperial gallons per hour divided by the square root of the pressure drop through the injector in pounds force per square inch. Conventionally, if high flow number nozzles are used, which give good fuel atomization at high fuel flow rates, they cannot adequately atomize the fuel at low fuel flow rates, and this leads to larger fuel droplets which are more liable to impinge and burn on combustor surfaces, thereby leading to coking of the surfaces. However, the use as described above of charged electrodes both in the injector nozzles and in the combustor components reduces or eliminates this problem.

(h) Enabling use of a wider range of liquid fuel types, due again to better atomization and control of fuel placement.

(i) Improving fuel and air mixing which results in reducing unburnt hydrocarbon emissions in the form of white smoke.

Figure 5:
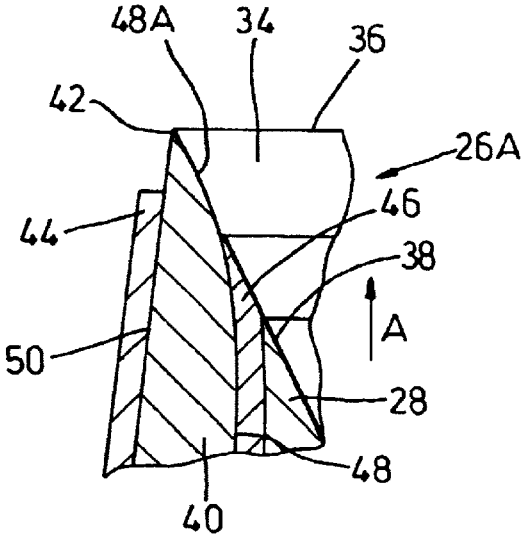
FIG. 5 is a fragment comparable to FIG. 4 of a section of another embodiment of fuel injection nozzle formed according to the invention.

In FIG. 5 a fragment of a modified injection nozzle is shown at 26A in which an uppermost face portion 48A of the radially inner face 48 of the electrode 40 is of convex-bevel shape with respect to the passage 34 and is more exposed to the passage than the upper end of the electrode 40 of the nozzle 26 (FIGS. 3 and 4). This may give a longer wear life than the embodiment of FIG. 4, since the sharp edge 36 has a larger included angle than that shown in FIG. 4, though the edge radius need be no larger. However, the larger included angle of the edge may give a penalty in reduced effectiveness of imparting charge to the fuel.

Figure 6:
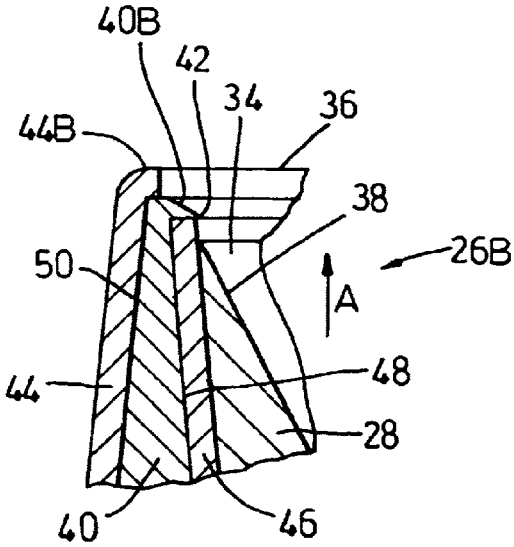
FIG. 6 is a fragment comparable to FIG. 4 of a section of a further embodiment of fuel injection nozzle formed according to the invention.

In FIG. 6 a fragment of another modified injection nozzle is shown at 26B in which the upper end 36 of the passage 34 is defined by an outer surface of a radially inturned lip 44B on the outer insulation tube 44. The lip 44B covers at least in part a substantially radially inwardly directed (with respect to the passage 34) inturned beak or lip 40B at the upper end of the electrode 40, the lip bearing the sharp edge 42 which projects the electric charge in a direction substantially transverse to the direction A of fuel flow. In this case the sharp edge 42 is inset in the passage 34 for protection from erosion at a position somewhat upstream of the downstream passage end 36. This arrangement may give more efficient charge emission to the fuel stream immediately prior to its leaving the nozzle, especially in the case of fuels having high viscosity.

I claim:

1. A liquid fuel injection nozzle for supplying electrostatically charged fuel to a combustion chamber in a gas turbine engine, the nozzle comprising:

a) a nozzle body;

b) a fuel passage within the nozzle body and having an exit for the fuel to leave the nozzle;

c) electrode means disposed around the nozzle body, the electrode means having an inner surface and an outer surface;

d) electrical insulation means for insulating the inner surface of the electrode means from the nozzle body and for insulating the outer surface of the electrode means from its environment; and (e) said electrode means having sharp edge means formed by intersection of the inner and outer surfaces, said sharp edge means forming part of a wall of the passage, and being free of the electrical insulation means, and being positioned for imparting electrostatic charge to the fuel as the fuel leaves the passage exit.

2. The liquid fuel injection nozzle as claimed in claim 1, in which at least the sharp edge means comprises an erosion resistant material.

3. The liquid fuel injection nozzle as claimed in claim 1, in which the sharp edge means comprises the exit of the passage.

4. The liquid fuel injection nozzle as claimed in claim 1, in which the electrode means is adjacent the exit of the passage.

5. The liquid fuel injection nozzle as claimed in claim 1, in which the sharp edge means projects substantially along a general direction of flow of fuel along the passage.

6. The liquid fuel injection nozzle as claimed in claim 1, in which the sharp edge means projects substantially across a general direction of flow of fuel along the passage.

7. The liquid fuel injection nozzle as claimed in claim 6, in which the sharp edge means projects across an interior of the passage.

8. The liquid fuel injection nozzle as claimed in claim 1, in which the electrode means forms at least part of a wall of the passage.

9. The liquid fuel injection nozzle as claimed in claim 1, in which the passage is divergent in the direction of the exit.

10. The liquid fuel injection nozzle as claimed in claim 1, comprising a spin chamber for swirling the fuel before entry to the passage.

11. The liquid fuel injection nozzle as claimed in claim 10, in which the passage includes a throat portion in communication with the spin chamber.

* * * * *

UNITED STATES PATENT AND TRADEMARK OFFICE

CERTIFICATE OF CORRECTION

PATENT NO. : 6,695,234 B2
DATED : February 24, 2004
INVENTOR(S) : Nigel Wilbraham It is certified that error appears in the above-identified patent and that said Letters Patent is hereby corrected as shown below:

Title page,
Item [73], Assignee, the name should read:
-- Alstom Power N.V. -- not "Alstone Power N.V."

Signed and Sealed this

Eighth Day of June, 2004

JON W. DUDAS
*Acting Director of the United States Patent and Trademark Office*